US006243907B1

(12) United States Patent
Wagner

(10) Patent No.: US 6,243,907 B1
(45) Date of Patent: Jun. 12, 2001

(54) GOLF SHOE CLEANING DEVICE

(76) Inventor: James F. Wagner, 13101 Brandon Way Rd., Gaithersburg, MD (US) 20878

( * ) Notice: Subject to any disclaimer, the term of this patent is extended or adjusted under 35 U.S.C. 154(b) by 0 days.

(21) Appl. No.: 09/333,553

(22) Filed: Jun. 16, 1999

(51) Int. Cl.[7] ..... A47L 23/22
(52) U.S. Cl. ..... 15/112; 15/161; 15/237
(58) Field of Search ..... 15/161, 112, 185, 15/237, 238, 215, 216, 217

(56) References Cited

U.S. PATENT DOCUMENTS

| | | | | |
|---|---|---|---|---|
| 188,612 | * | 3/1877 | Ellis et al. | 15/112 |
| 344,733 | * | 6/1886 | Goldthwait | 15/112 |
| 350,879 | * | 10/1886 | Freytag | 15/112 |
| D. 396,909 | | 8/1998 | Carter | D32/47 |
| 600,376 | * | 3/1898 | Reeves et al. | 15/112 |
| 640,038 | * | 12/1899 | Smead et al. | 15/112 |
| 662,237 | * | 11/1900 | Lamb | 15/112 |
| 719,894 | * | 2/1903 | Smith | 15/112 |
| 726,201 | * | 4/1903 | Strombeck | 15/161 |
| 867,028 | * | 9/1907 | Frisch | 15/112 |
| 899,515 | * | 9/1908 | De Lapp | 15/112 |
| 905,583 | * | 12/1908 | Rich | 15/112 |
| 955,769 | * | 4/1910 | Dahlfues | 15/112 |
| 965,363 | * | 7/1910 | Benn | 15/112 |
| 1,124,650 | * | 1/1915 | Perron | 15/112 |
| 1,136,528 | * | 4/1915 | Higley | 15/112 |
| 1,138,232 | * | 5/1915 | McGann | 15/112 |
| 1,149,729 | * | 8/1915 | Clippinger | 15/112 |
| 1,168,341 | * | 1/1916 | Simmons | 15/112 |
| 1,327,943 | * | 1/1920 | Cohen | 15/112 |
| 1,526,233 | * | 2/1925 | Rance, Sr. | 15/112 |
| 2,210,365 | * | 8/1940 | Gilpin | 15/112 |
| 2,436,234 | * | 2/1948 | Stein | 15/161 |
| 3,064,296 | * | 11/1962 | Lidke | 15/161 |
| 3,074,093 | * | 1/1963 | McDonald | 15/161 |
| 3,747,150 | | 7/1973 | Kozub | 15/105 |
| 4,571,767 | | 2/1986 | Dangler | 15/161 |
| 4,617,917 | * | 10/1986 | Miller | 15/161 |
| 4,670,932 | | 6/1987 | Williams | 15/237 |
| 4,785,490 | | 11/1988 | Thomas | 15/237 |
| 5,230,117 | | 7/1993 | Johnson et al. | 15/106 |
| 5,479,674 | | 1/1996 | Gilcrest | 15/161 |
| 5,555,589 | | 9/1996 | Moultrie | 15/105 |

* cited by examiner

*Primary Examiner*—Gary K. Graham
(74) *Attorney, Agent, or Firm*—Dale J. Ream

(57) ABSTRACT

A cleaning device includes a cleaning member having a plurality of bristles extending from an upper surface thereof for cleaning a golf shoe. The cleaning device further includes a plate coupled to an end of the cleaning member and pivotal between a first open position laterally adjacent to the cleaning member and a second closed position covering the bristles. The bristles extend both upwardly and inwardly for simultaneously cleaning the sides, sole, and cleats of a golf shoe as the shoe is scraped across the cleaning member.

10 Claims, 6 Drawing Sheets

GOLF SHOE CLEANING DEVICE

BACKGROUND OF THE INVENTION

This invention relates to golf accessories and, more particularly, to a golf shoe cleaning device for simultaneously cleaning the sole, cleats, and sides of a golfer's shoe while the golfer remains in a standing position.

Golf shoes typically include cleats which provide improved traction to a golfer who often needs to address the golf ball while standing on a variety of different surfaces, such as grass, dirt, sand, and mud. The golfer's traction becomes increasingly impaired as the cleats become filled with grass, mud, etc. A lack of adequate traction may result in an errant shot by the golfer or even injury to the golfer.

Several devices have been proposed for cleaning the soles or cleats of a golf shoe. Some devices require the golfer to grasp the cleaning device and first scrape the soles or cleats and then the sides of the shoe. Use of these devices usually requires the golfer to be seated or to remove the muddy shoe. Other devices such as those shown in U.S. Pat. No. 5,230,117 to Johnson et al., and U.S. Pat. No. 5,555,589 to Moultrie do not provide a cleaning surface that is covered and stored such that the dirt or grass on the cleaning surface does not contaminate other items.

Therefore, it is desirable to have a golf shoe cleaning device that can simultaneously clean the sole, cleats, and sides of a golf shoe as it is scraped across a cleaning surface. It is also desirable that a golfer can clean a golf shoe while remaining in an upright position. Further, it is desirable to have a device in which the cleaning surface can be covered when not in use so as to eliminate contact between the cleaning surface and adjacent items.

SUMMARY OF THE INVENTION

A golf shoe cleaning device constructed in accordance with the present invention includes a cleaning member having generally parallel upper and lower planar surfaces. The lower surface allows the cleaning member to be placed upon the ground during use. The upper surface includes opposing side walls. A plurality of bristles extends upwardly from the upper surface as well as extending inwardly from each of the side walls. Thus, the sole, cleats, and sides of a golf shoe may be cleaned simultaneously as a shoe is scraped across the cleaning member.

The device further includes a plate pivotally coupled to an end of the cleaning member. In an open position, a golfer may place one foot on the plate while scraping the shoe of the other foot across the cleaning member. Thus, the cleaning member is held substantially stationary by the weight of the golfer on the plate. The plate may be pivoted to a closed position in which the plate is parallel to the upper surface of the cleaning member and completely covers the bristles so that grass, dirt, etc. is not dislodged during storage.

The device may also include another plate slidably attached to the sides of the cleaning member and extendable therefrom. With the second plate extended, a golfer may stand on either plate while scraping the shoe of the other foot across the cleaning member.

It is therefore a general object of this invention to provide a golf shoe cleaning device for cleaning the soles, cleats, and sides of golf shoes.

Another object of this invention is to provide a device, as aforesaid, having horizontally and vertically disposed bristles which simultaneously clean the sole, cleats, and sides of a golf shoe as the shoe is scraped across a cleaning member.

Still another object of this invention is to provide a device, as aforesaid, which may be held stationary by one foot of a user while cleaning the golf shoe on the other of the user's feet.

Yet another object of this invention is to provide a device, as aforesaid, which can clean the shoes of a user while the user remains in an upright position.

A further object of this invention is to provide a device, as aforesaid, having a cover plate pivotal between open and closed positions such that the cover plate may cover the bristles to prevent debris from contaminating surrounding items.

A still further object of this invention is to provide a device, as aforesaid, having teeth for scraping mud from a shoe.

Another object of this invention is to provide a device, as aforesaid, which may be grasped and used as a hand brush.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
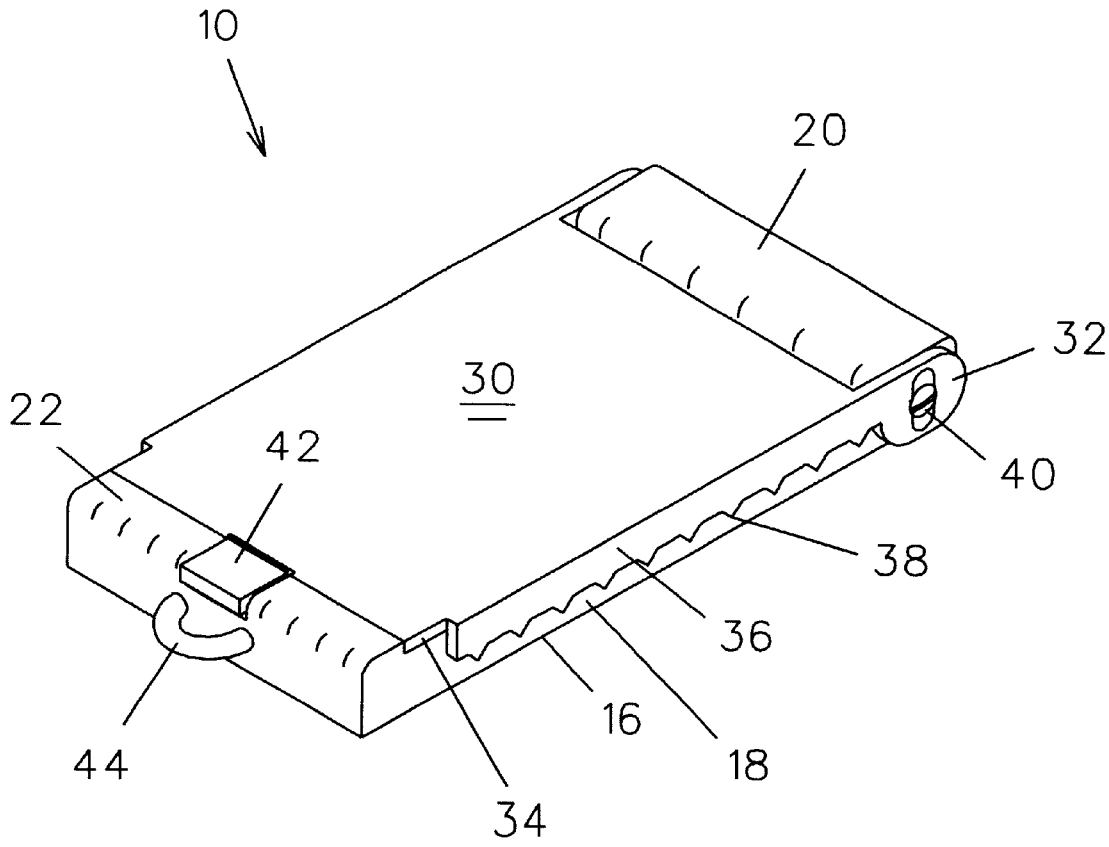
FIG. 1 is a perspective view of the golf shoe cleaning device in a closed position according to the present invention.
Figure 2:
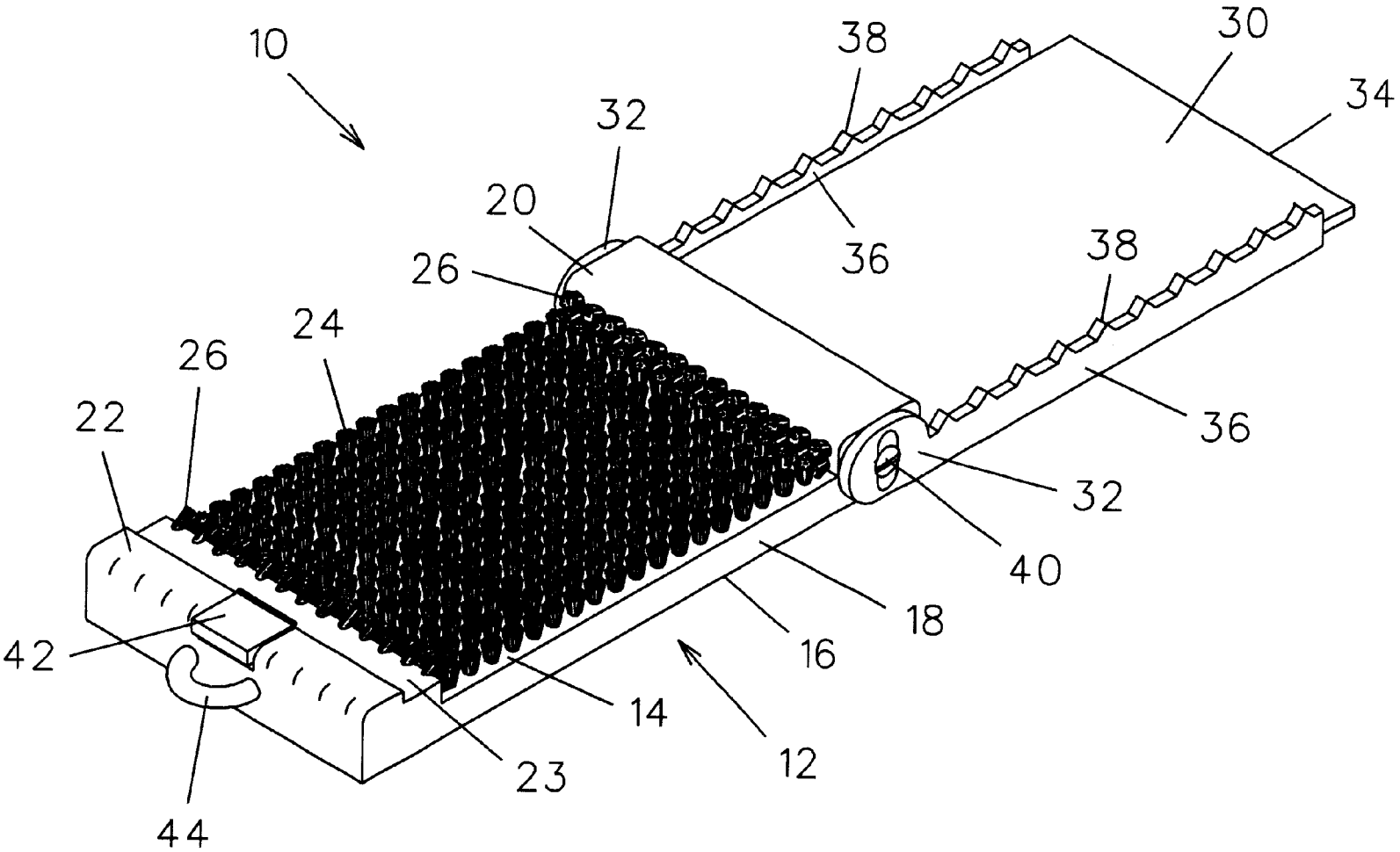
FIG. 2 is a perspective view of the device in an open position.
Figure 3:
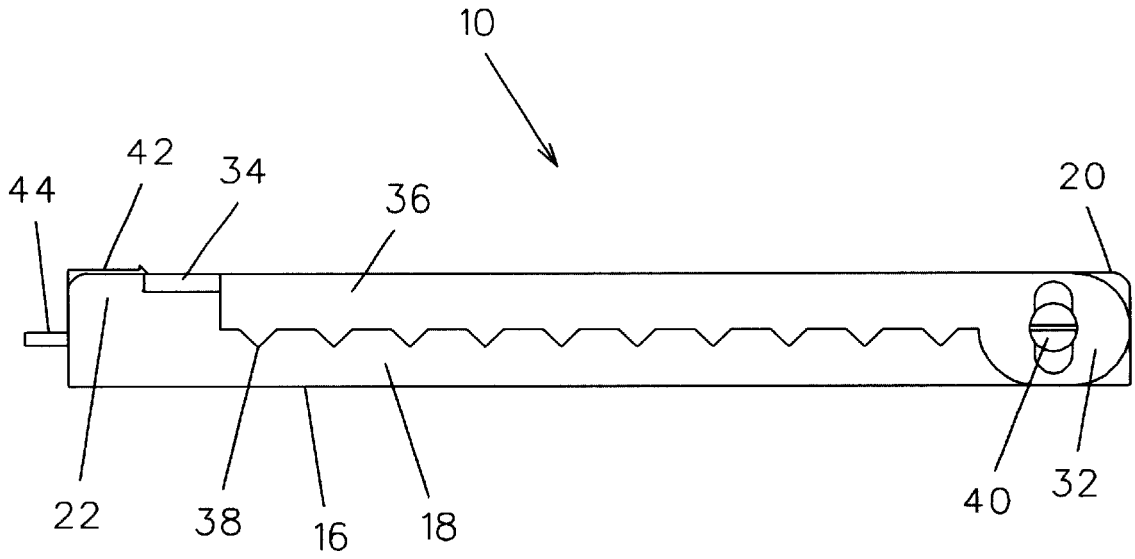
FIG. 3 is a side view of the device of FIG. 1.

Turning more particularly to the drawings, FIGS. 1 through 3 show the preferred embodiment of the golf shoe cleaning device 10. The device 10 comprises a cleaning member 12 pivotally coupled to a cover plate 30. The device is constructed of a durable and waterproof material. The cleaning member 12 has a generally rectangular shape that includes planar upper 14 and lower 16 surfaces, side surfaces 18, a first end 20 and a second end 22. The lower surface 16 may have a smooth, flat surface, or have a tread surface for enhanced traction. First 20 and second 22 ends extend upwardly from the upper surface 14 of the cleaning member 12 to form a recessed area therebetween. A first plurality of bristles 24 extend upwardly from the upper surface 14 and substantially cover the entire surface area thereof (FIG. 2). A second plurality of bristles 26 extend inwardly from first 20 and second 22 ends. The second plurality of bristles 26 extend the entire width of the cleaning member 12 and are normal to the upwardly extending bristles 24. The bristles are formed of a rigid fibrous material, but may also be formed of polypropylene or flexible steel material according to the coarseness desired.

The extent of the recessed area between the first 20 and second 22 ends is approximately the width of a golf shoe such that the sole, cleats, and sides of the shoe are simultaneously cleaned when a shoe is scraped across the cleaning member 12.

The cover plate 30 has a rectangular shape that includes mounting brackets 32 at one end, an opposed free end 34, and side walls 36. Teeth 38 are formed in the upper edges of the side walls 36 for scraping debris from a golf shoe as to be further described below. The cover plate 30 is pivotally coupled to the cleaning member 12 with spring hinges 40 that extend through the mounting brackets 32 and are attached to the first end 20 of the cleaning member 12. The hinges 40 are biased such that the device 10 is normally in an open position in which the cleaning member 12 and cover plate 30 are adjacent one another in the same horizontal plane. Thus, a golfer can scrape mud from the sole or cleats of a golf shoe using the teeth 38 of the cover plate 30 or can stand on the cover plate 30 to hold the cleaning member 12 stationary while scraping the other shoe across the bristles 24, 26 thereon. It is understood that the cover plate 30 has a width sufficient to receive a golf shoe thereon.

A recessed area 23 in the top of the second end 22 of the cleaning member 12 is configured to receive the free end 34 of the cover plate 30. The second end 22 further includes a push button latch 42 that extends slightly over the recessed area 23 to capture the free end 34 of the cover plate 30 when pivoted to a closed position (FIGS. 1 and 3). In a closed position, the cover plate 30 completely encloses the bristles 24, 26 of the cleaning member 12 to prevent debris from being dislodged from the bristles when the device 10 is not in use. The cover plate 30 may be released to pivot to its normally open position (FIG. 2) according to the bias of the spring hinges 40 by pressing the latch button 42. A D-Ring 44 extends outwardly from the second end 22 of the cleaning member 12 for attaching the device 10 to a golf bag or other desired location.

In use, the golf shoe cleaning device 10 is fastened to a golf bag with the D-Ring 44 or carried in a pocket of the bag during game play. When needed to clean a shoe, the device 10 is placed on the ground or other flat surface. The cover plate 30 is then released by pressing the latch button 42 with a finger or even with a shoe to allow the cover plate 30 to flip to an open use position. Mud can be scraped from the sole or cleats of a shoe with the teeth 38 on the cover plate. Alternatively, the user may stand with one foot on the cover plate 30 to hold the cleaning member 12 substantially stationary while scraping the shoe of the other foot across the cleaning member 12. When finished cleaning the shoes, the cover plate 30 is pivoted to its closed position until the device 10 is needed again.

Figure 4:
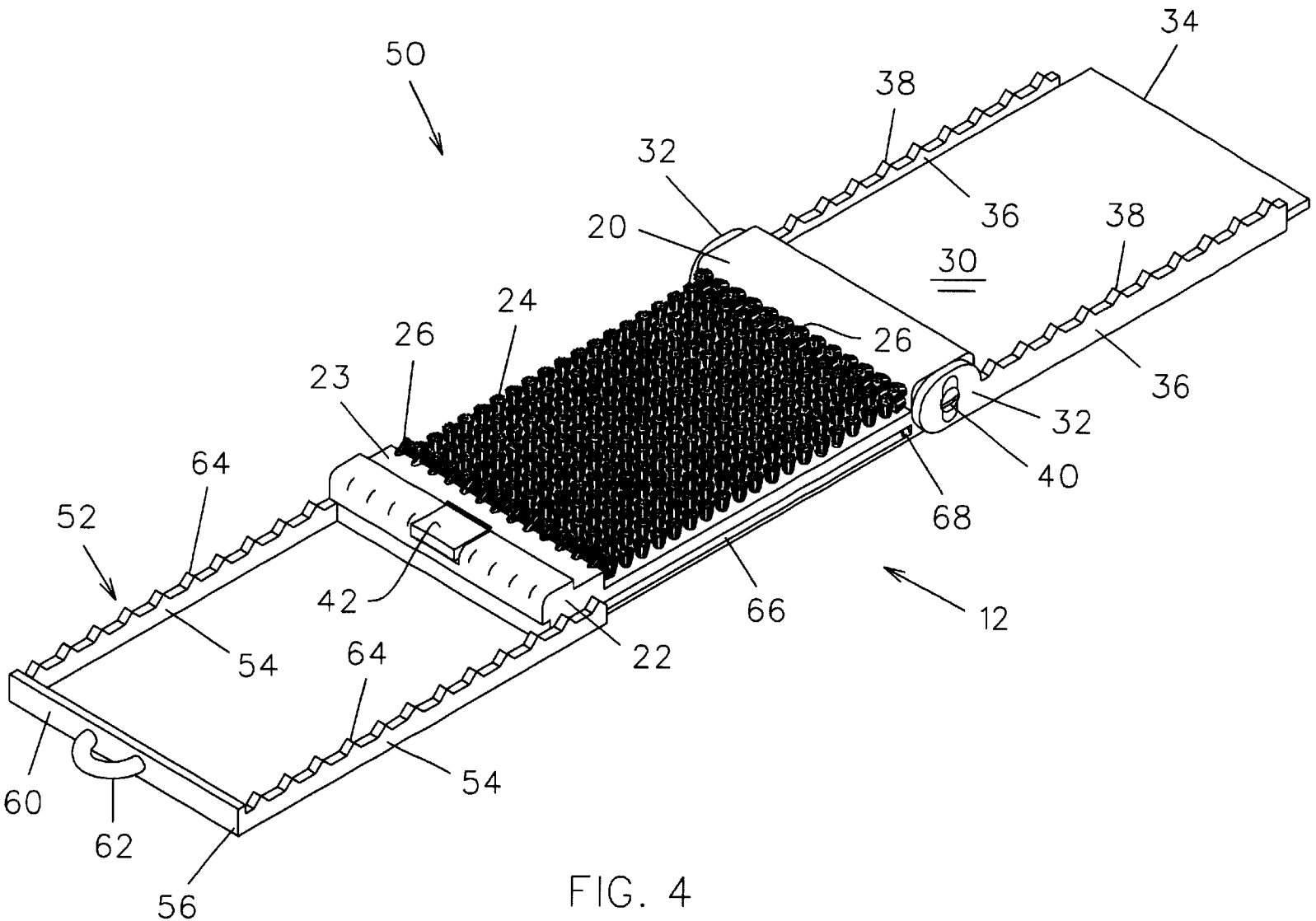
FIG. 4 is a perspective view of an alternative embodiment of the device in an open position.
Figure 5:
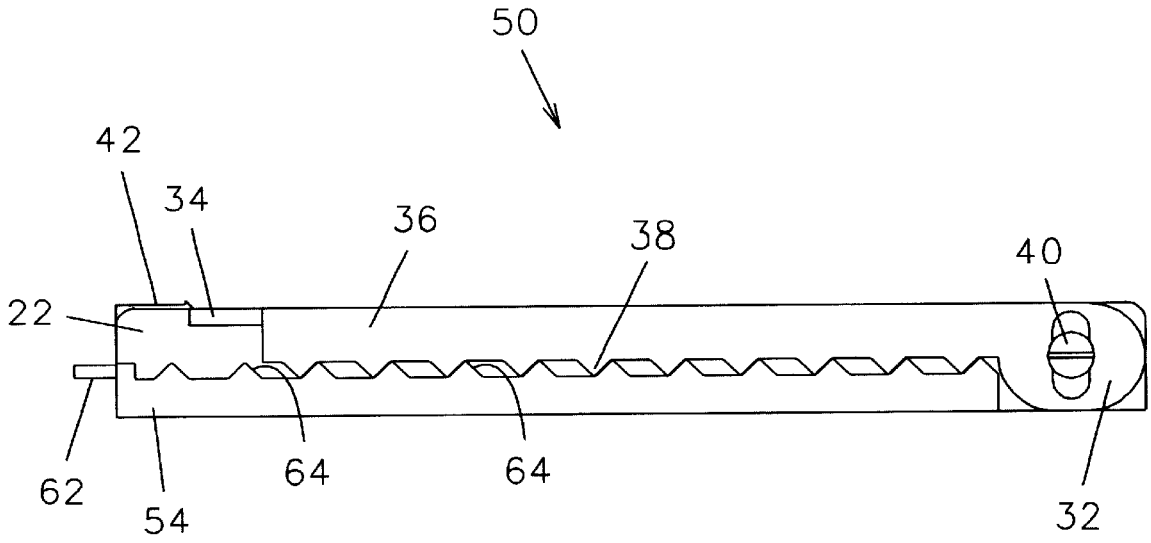
FIG. 5 is a side view of the device of FIG. 4 in a closed position.
Figure 6:
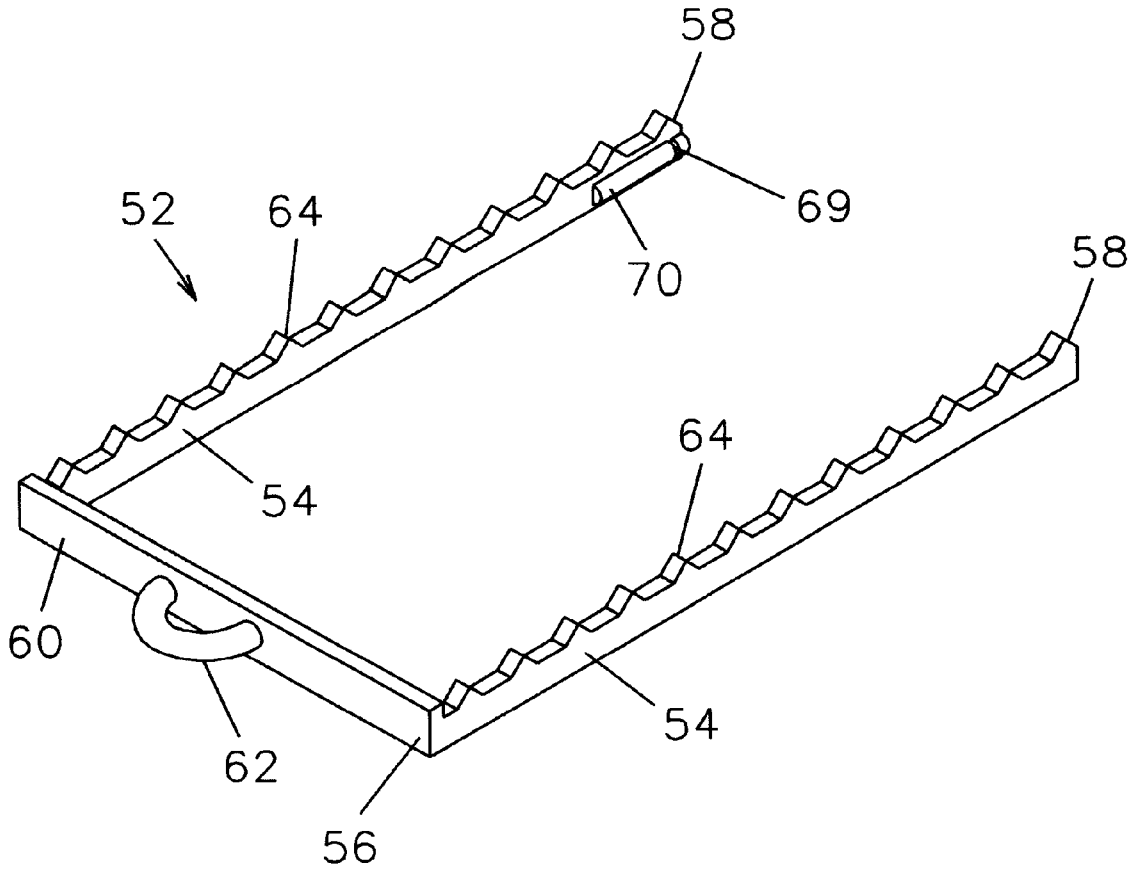
FIG. 6 is a perspective view of a bracket removed from the device as in FIG. 4.

An alternative embodiment of the device 50 is shown in FIGS. 4 and 5 and is identical in construction to the device 10 previously described, except as noted below. The alternative embodiment of the device 50 comprises a bracket 52 having an identical pair of oppositely disposed parallel arms 54 integrally connected at proximal ends 56 to an end wall 60 intermediate arms 54. A D-Ring 62 extends outwardly from the end wall 60. Upper edges of the arms 54 form teeth 64 as previously described. Each side surface 18 of the cleaning member 12 includes an arcuate channel 66 that extends substantially the length of the cleaning member 12. As particularly shown in FIG. 6, flanges 70 extend inwardly from the arms 54 and are substantially adjacent distal ends 58 thereof. The flanges 70 are configured to mate with the channels 66. Each channel 66 includes a protrusion 68 adjacent the first end 20 of the cleaning member 12 which mates with an indention 69 in each flange for frictionally releasably holding the arms 54 of the bracket 52 when it is in a completely non-extended position. Therefore, the flanges 70 of the bracket 52 are slidable within channels 66 for moving the bracket 52 between a first extended position laterally adjacent the cleaning member 12 and a second non-extended position in which the bracket arms 54 sandwich the cleaning member 12.

In use, the alternative embodiment of the device allows a user to hold the cleaning member 12 substantially stationary by stepping on the arms 54 of the bracket 52 while scraping the shoe of the other foot across the cleaning member 12. The user may then hold the cleaning member 12 in place by standing on the cover plate 30 while cleaning the other shoe with the cleaning member 12. Thus, a golfer can clean both shoes quickly without having to reorient the body relative to the device.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A shoe cleaning device, comprising:

a cleaning member having an upper surface and first and second ends extending upwardly therefrom;

a plurality of bristles extending from said upper surface for cleaning a shoe;

a plate pivotally coupled to said first end of said cleaning member and pivotal between a first open position laterally adjacent said cleaning member and a second closed position covering said bristles; and a bracket having an end wall and a pair of oppositely disposed parallel arms connected to said end wall, said bracket coupled to said cleaning member and slidable between a first extended position laterally adjacent said cleaning member and a second storage position wherein said cleaning member is sandwiched between said arms.

2. A shoe cleaning device as in claim 1 further comprising a spring hinge for pivotally coupling said plate to said cleaning member, said spring hinge biasing said plate in said first open position.

3. A shoe cleaning device as in claim 2 wherein said second end of said cleaning member presents a recess adapted to receive a free end of said plate therein when said plate is pivoted to said second closed position, said second end further including a latch for holding said plate in said recess.

4. A shoe cleaning device as in claim 1 wherein said cleaning member includes a first end pivotally coupled to said plate and a second end presenting a recess adapted to receive a free end of said plate therein when said plate is pivoted to said second closed position.

5. A shoe cleaning device as in claim 1 wherein said cleaning member includes spaced apart side walls extending between said first and said second ends, each said side wall defining a channel therein;

each said arm having a flange adapted to slidably mate with each said channel, respectively.

6. A shoe cleaning device as in claim 5 wherein each said channel includes a nub, each said flange presenting an indention adapted to mate with each said nub for releasably holding said bracket in said second storage position.

7. A shoe cleaning device as in claim 1 wherein said arms include upwardly extending teeth therealong for cleaning the sole and cleats of a golf shoe.

8. A shoe cleaning device as in claim 1 wherein said said plurality of bristles includ bristles extending upwardly from said upper surface and bristles extending inwardly from said first and second ends.

9. A shoe cleaning device as in claim 8 wherein said upwardly extending bristles and said inwardly extending bristles are made of a polypropylene material.

10. A shoe cleaning device as in claim 1 wherein said plate includes oppositely disposed side walls having upwardly extending teeth therealong for cleaning the sole and cleats of a golf shoe.

* * * * *